US007571578B2

(12) United States Patent
Moody et al.

(10) Patent No.: US 7,571,578 B2
(45) Date of Patent: Aug. 11, 2009

(54) THERMAL WALL SYSTEM

(75) Inventors: Donald R. Moody, Denton, TX (US); Courtney J. Hanson, Denton, TX (US)

(73) Assignee: Nucon Steel Corporation, Denton, TX (US)

( * ) Notice: Subject to any disclaimer, the term of this patent is extended or adjusted under 35 U.S.C. 154(b) by 779 days.

(21) Appl. No.: 10/711,822

(22) Filed: Oct. 7, 2004

(65) Prior Publication Data

US 2005/0076600 A1 Apr. 14, 2005

Related U.S. Application Data

(60) Provisional application No. 60/481,484, filed on Oct. 8, 2003.

(51) Int. Cl.

| | |
|---|---|
| ***E04B 1/74*** | (2006.01) |
| ***E04B 1/94*** | (2006.01) |
| ***E04C 2/34*** | (2006.01) |
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |

(52) U.S. Cl. ..... 52/481.1; 52/241; 52/317; 52/407.4; 52/481.2; 52/775

(58) Field of Classification Search ..... 52/241, 52/317, 354, 407.4, 481.1, 481.2, 762, 764, 52/772, 775, 781.3, 715, 290, 506.01
See application file for complete search history.

(56) References Cited

U.S. PATENT DOCUMENTS 807,251 A 10/1907 Davis (Continued)

FOREIGN PATENT DOCUMENTS

CA 1079473 6/1980

(Continued)

OTHER PUBLICATIONS

U.S. Appl. No. 10/711,118, Office Action dated Jun. 4, 2007.

(Continued)

*Primary Examiner*—Brian E. Glessner
*Assistant Examiner*—Branon C Painter
(74) *Attorney, Agent, or Firm*—Matthew W. Witsil; Moore & Van Allen PLLC

(57) ABSTRACT

A thermal wall system for slowing heat transfer through walls. The system includes horizontal top and bottom tracks, horizontal top and bottom plates, and vertical studs mounted to and extending between the top and bottom plates. The top tracks and plates have flanges that extend downward. The bottom tracks and plates have flanges that extend upward. The width of the plates fits within the width of the tracks. Top and bottom tracks and plates are respectively nested along their webs and one flange to form a longitudinal opening between their respective opposing flanges. Rigid insulation may be disposed in the longitudinal opening. Thermal framing components may also be provided, extending between the top and bottom plates, to support vertical edges of insulation sheets. Thermal end caps may be used to treat the terminal edges of insulation.

18 Claims, 7 Drawing Sheets

U.S. PATENT DOCUMENTS

| | | | | | |
|---|---|---|---|---|---|
| 876,399 | A | | 1/1908 | Robinson | |
| 1,074,242 | A | * | 9/1913 | Caldwell | 52/354 |
| 1,130,722 | A | | 3/1915 | Fletcher | |
| 1,481,249 | A | | 1/1924 | Beinecke | |
| 1,867,194 | A | | 7/1932 | Taylor | |
| 1,867,329 | A | * | 7/1932 | Ryan | 52/354 |
| 1,905,616 | A | * | 4/1933 | Apollony | 52/715 |
| 2,185,335 | A | | 1/1940 | Fischer | |
| 2,209,514 | A | | 7/1940 | Drummond | |
| 2,779,978 | A | | 2/1957 | Sundelin | |
| 3,217,460 | A | | 11/1965 | Downing | |
| 3,411,252 | A | * | 11/1968 | Boyle, Jr. | 52/126.4 |
| 3,481,090 | A | * | 12/1969 | Lizee | 52/241 |
| 3,996,712 | A | * | 12/1976 | Howell | 52/241 |
| 3,999,343 | A | | 12/1976 | Roberts | |
| 4,361,994 | A | * | 12/1982 | Carver | 52/238.1 |
| 4,435,936 | A | * | 3/1984 | Rutkowski | 52/481.1 |
| 4,478,018 | A | | 10/1984 | Holand | |
| 4,633,634 | A | | 1/1987 | Nemmer et al. | |
| 4,702,058 | A | | 10/1987 | Bennett | |
| 5,269,109 | A | | 12/1993 | Gulur | |
| 5,325,651 | A | | 7/1994 | Meyer | |
| 5,353,560 | A | | 10/1994 | Heydon | |
| 5,417,023 | A | | 5/1995 | Mandish | |
| 5,524,400 | A | | 6/1996 | Schmechel | |
| 5,653,079 | A | | 8/1997 | Loeffler et al. | |
| 5,664,378 | A | | 9/1997 | Bettigole et al. | |
| 5,765,330 | A | | 6/1998 | Richard | |
| 5,799,462 | A | | 9/1998 | McKinney | |
| 5,953,883 | A | | 9/1999 | Ojala | |
| 6,266,936 | B1 | | 7/2001 | Gelin | |
| 6,415,575 | B1 | | 7/2002 | Thompson | |
| 6,421,972 | B1 | | 7/2002 | Dalphond et al. | |
| 6,615,563 | B1 | | 9/2003 | Nanayakkara | |
| 6,640,516 | B1 | | 11/2003 | Thompson | |
| 6,708,459 | B2 | | 3/2004 | Bodnar | |
| 6,711,867 | B1 | | 3/2004 | Smith | |
| 7,028,439 | B2 | | 4/2006 | Foderberg et al. | |
| 7,051,484 | B2 | | 5/2006 | Nanayakkara | |
| 7,197,854 | B2 | | 4/2007 | Bettigole et al. | |
| 2001/0004820 | A1 | * | 6/2001 | Poliquin | 52/41.1 |
| 2003/0014934 | A1 | | 1/2003 | Bodnar | |
| 2003/0056456 | A1 | | 3/2003 | Heydon | |
| 2004/0045252 | A1 | | 3/2004 | Nanayakkara | |
| 2005/0055934 | A1 | | 3/2005 | Moody | |

FOREIGN PATENT DOCUMENTS

| | | |
|---|---|---|
| CA | 1166815 | 5/1984 |

OTHER PUBLICATIONS

U.S. Appl. No. 10/711,118, Non-Final Office Action dated Nov. 23, 2007.
U.S. Appl. No. 10/711,118, Final Office Action dated May 13, 2008.
U.S. Appl. No. 10/711,118, Advisory Action dated Jul. 21, 2008.
U.S. Appl. No. 10/711,118, Non-Final Office Action dated Oct. 14, 2008.

* cited by examiner

THERMAL WALL SYSTEM

CROSS REFERENCE TO RELATED APPLICATIONS

This application claims priority from U.S. provisional application 60/481,484, filed Oct. 8, 2003, by the inventors hereof, the entire disclosure of which is incorporated herein by reference.

BACKGROUND

The present invention relates to thermal insulation of walls, and more particularly to systems for supporting rigid insulation in structural framing applications.

Walls of buildings may include framing made of light gauge steel, wood, or a combination thereof. In addition to structural requirements that the framing must meet, thermal characteristics are important, especially for exterior walls. Minimizing heat transfer through the walls is desirable both for comfort and for energy efficiency of heating and air conditioning. For example, when the outdoors is cold relative to inside a heated structure, heat from indoors should be prevented from passing through the walls to the outdoors. Conversely, when the outdoors is hot relative to inside an air conditioned structure, heat from outdoors should be prevented from passing through the walls to the inside. The degree of prevention of heat transfer may be based on considerations of technical feasibility as well as cost.

Heat transfer through walls may be addressed in a variety of ways. Framing may include a top plate, a bottom plate or sill, vertical posts or studs, and mid-section blocking, among other components. Spun fiberglass insulation is commonly placed in the cavities formed by the framing components. Rigid insulation sheets or panels, such as those made from expanded or extruded polystyrene or polyisocyanurate, may also be used. Another method is to inject foam insulation into the cavities. While each of these methods reduces conduction of heat through the areas between framing components, they generally do not address conduction through the components themselves, which may present a direct and continuous path for heat transfer across the wall.

Several known designs for insulating walls with metal members attempt to minimize heat transfer by using rigid insulation. The metal members may be, among other things, "C" shaped in cross-section, meaning having a web, first and second flanges generally perpendicular to the web, and returns on each flange, or "U" shaped in cross-section, having a web and first and second flanges generally perpendicular to the web, without returns. The flanges of the members are sometimes embedded in the rigid insulation in slots that are formed by "hot-wiring" the insulation. Such construction adds to the complexity of manufacturing and fabrication, and limits the ability to make on-site modifications.

For the foregoing reasons, there exists a need for a framing system that supports rigid insulation to limit heat transfer through a wall, is relatively easy and quick to install, and may allow field modifications.

SUMMARY OF THE INVENTION

In accordance with an embodiment of the present invention, a thermal wall system includes top and bottom tracks, top and bottom plates, and vertical studs mounted to and extending between the top and bottom plates. Each track and plate includes a web in an approximately horizontal plane, a first flange, and a second flange. The top track flanges and top plate flanges extend downward at approximately right angles to the web. The bottom track flanges and bottom plate flanges extend upward at approximately right angles to the web. The web and first flanges of the top track and top plate are substantially nested. The second flanges of the top track and top plate are spaced, forming a longitudinal opening. Likewise, the web and first flanges of the bottom track and bottom plate are substantially nested and the second flanges of the bottom track and bottom plate are spaced, forming a longitudinal opening. The top track and bottom track oppose each other, the top plate and bottom plate oppose each other, and the longitudinal openings oppose each other.

In accordance with another embodiment of the present invention, rigid insulation disposed between the top and bottom tracks includes two approximately horizontal edges respectively disposed in the longitudinal openings and two approximately vertical edges.

In accordance with another embodiment of the present invention, a vertical thermal framing component is provided and extends between the top and bottom plates. The thermal framing component includes a web with projections from each edge at right angles to the web in both directions, such that a slot is formed on each side of the web.

In accordance with another embodiment of the present invention, a thermal wall system includes top and bottom tracks, top and bottom plates, and vertical studs mounted to and extending between the top and bottom plates. Each track and plate includes a web in an approximately horizontal plane, a first flange, and a second flange. The top track and top plate flanges extend downward at approximately right angles to the web. The bottom track and bottom plate flanges extend upward at approximately right angles to the web. The web and first flanges of the top track and top plate are substantially nested. The second flanges of the top track and top plate are spaced, forming a longitudinal opening. Likewise, the web and first flanges of the bottom track and bottom plate are substantially nested and the second flanges of the bottom track and bottom plate are spaced, forming a longitudinal opening. Vertical thermal framing components interposed between the studs and extending between the top and bottom plates, each include an elongated planar web including a longitudinal axis, a first edge parallel to the longitudinal axis, a second edge parallel to the longitudinal axis, a first side, and a second side. Each thermal framing component has four of more tabs: a first tab extending from the first edge at approximately a 90 degree angle from the first side; a second tab extending from the first edge at approximately a 90 degree angle from the second side; a third tab extending from the second edge at approximately a 90 degree angle from the second side, wherein the second and third tabs form a slot; and a fourth tab extending from the second edge at approximately a 90 degree angle from the first side, wherein the first and fourth tabs form a slot. There are a plurality of rigid insulation sheets disposed between the top and bottom tracks, each sheet including two approximately horizontal edges respectively disposed in the longitudinal openings and two approximately vertical edges, each of which is disposed in a slot. The top track and bottom track oppose each other, the top plate and bottom plate oppose each other, and the longitudinal openings oppose each other.

In accordance with another embodiment of the present invention in which a thermal wall system includes rigid insulation with an approximately vertical edge, a thermal end cap includes an approximately vertical web with flanges projecting from each edge at approximately right angles to one side of the web. The approximately vertical edge of rigid insulation is disposed between the flanges.

In accordance with another embodiment of the present invention, a method of assembling a thermal wall system includes providing a top plate including a web in an approximately horizontal plane, a first flange, and a second flange, the flanges extending downward at a right angle to the web. A bottom plate is provided including a web in an approximately horizontal plane, a first flange, and a second flange, the flanges extending upward at a right angle to the web. At least two approximately vertical studs are provided. One end of the studs is mounted to the top plate and the other end to the bottom plate. A top track is provided having a web in an approximately horizontal plane, an interior flange, and an exterior flange, with the flanges extending downward at a right angle to the web. A bottom track is provided having a web in an approximately horizontal plane, an interior flange, and an exterior flange, with the flanges extending upward at a right angle to the web. A top plate or bottom plate is mounted to the respective top track or bottom track, such that the selected plate is disposed in the respective track and the plate and track webs and first flanges are substantially nested and a first longitudinal opening is formed between the second flanges. At least one rigid insulation sheet is provided to fit between the top and bottom track and corresponding longitudinal openings. One horizontal edge of the rigid insulation sheet is inserted into the first longitudinal opening. The remaining track is mounted to the respective remaining plate, such that the remaining plate is disposed in the remaining track and the remaining plate and remaining track respective webs and first flanges are substantially nested and a second longitudinal opening is formed between the second flanges. The remaining free horizontal edge of the rigid insulation sheet is inserted in the second longitudinal opening.

In accordance with another embodiment of the present invention, the method of assembling a thermal wall system may further include providing at least two vertical thermal framing components, each including a web and projections from each edge at right angles to the web in both directions, such that a slot is formed on each side of the web. The thermal components are mounted to the top and bottom plates before mounting the top and bottom tracks to the respective plates. Each approximately vertical edge of the rigid insulation sheet is inserted into at least one thermal framing component slot.

In accordance with another embodiment of the present invention, a thermal end cap is provided including a vertical web with opposing flanges projecting from each edge at right angles to one side of the web. The thermal end cap is mounted on a vertical edge of a rigid insulation sheet, wherein the edge of the insulation is between the flanges.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DETAILED DESCRIPTION OF THE INVENTION

A thermal wall system of the present invention may receive and secure rigid insulation and may also provide an attachment surface for exterior finish materials. The thermal wall system may reduce conduction of heat through a wall by providing insulation and, as applicable, limiting direct conduction through some structural framing members.

The thermal wall system may include light gauge steel or other metal, and may be incorporated into conventional and proprietary wall framing components of light gauge steel or wood. The scope of the invention is not intended to be limited by materials or dimensions listed herein, but may be carried out using any materials and dimensions that allow the construction and operation of the present invention. Materials and dimensions depend on the particular application. Metal primary structural framing members may be "C" shaped, "U" shaped, or other shape as selected by one of ordinary skill in the art. Certain relative dimensions, sizes, and spacings are shown on the Figures and discussed herein; it should be understood that the dimensions, sizes, and spacings shown and discussed merely illustrate selected embodiments of the invention. Further, certain terms of orientation such as "top," "bottom," "upper," "lower," "horizontal," "vertical," "inner," "outer," "interior," and "exterior" are used for convenience and refer to the position of elements as shown in the Figures, which generally correspond to installed positions, but should not be construed as limiting to the invention.

Figure 1:
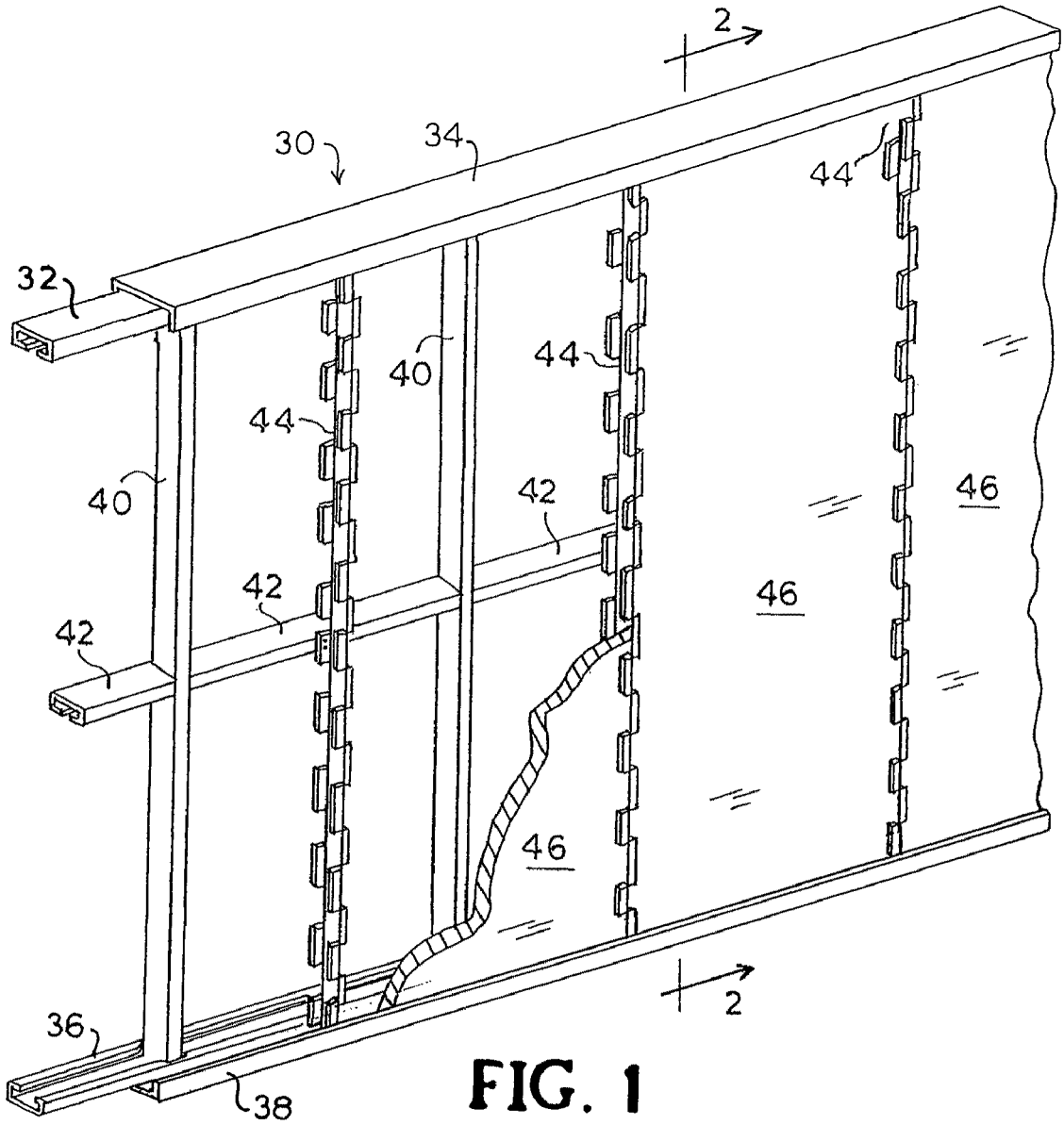
FIG. 1 is a perspective view of an embodiment of a thermal wall system according to the present invention.

FIG. 1 shows a thermal framing assembly 30 including a horizontal top plate 32, a horizontal top track 34 over and around the top plate 32, a horizontal bottom plate 36, a horizontal bottom track 38 beneath and around the bottom plate 36, vertical studs 40, horizontal mid-span blocking 42, and thermal framing components 44. As shown, the thermal components 44 may be attached to the top plate 32, bottom plate 36, and mid-span blocking 42. Mid-span blocking 42 could be eliminated based on design considerations. Rigid insulation sheets 46, cut away in part to expose the other components, extend between the thermal components 44 and between the top and bottom plates 32, 36. As shown in FIG. 1, the rigid insulation sheets 46 cover the studs 40 and mid-span blocking 42, eliminating direct conduction paths through metal in the wall, and therefore limiting corresponding conduction. Although there could be vertical members to which the thermal components 44 could be attached, none is required or shown. While the plates 32, 36, studs 40, and blocking 42 are shown as metal in FIG. 1, they could also be wood. Tracks 34, 38 may be metal or other material as selected by one of ordinary skill in the art. Thermal components 44 could be mounted to vertical studs (not shown) for additional stability.

Dimensions and spacing may be selected as known by one of ordinary skill in the art. For example, the plates may be 2½ inches (6.35 cm) wide, the tracks 3⅝ inches (9.21 cm) wide, and the insulation 1 inch (2.54 cm) thick, leaving a slight excess of space for the insulation. Or, the plates could be 3½ inches (8.89 cm) wide, the tracks 5½ inches (13.97) wide, and insulation 2 inches (5.08 cm) wide for a snug fit. Vertical studs 36 may be spaced, for example, at 24 inches (61 cm) on center. Where orientations are noted or shown it should be understood that the orientations are approximate, such as approximately horizontal and approximately vertical. Thermal components 44 may be spaced between the vertical studs 40, also 24 inches (61 cm) on center or as otherwise selected by one of ordinary skill in the art.

Figure 2:
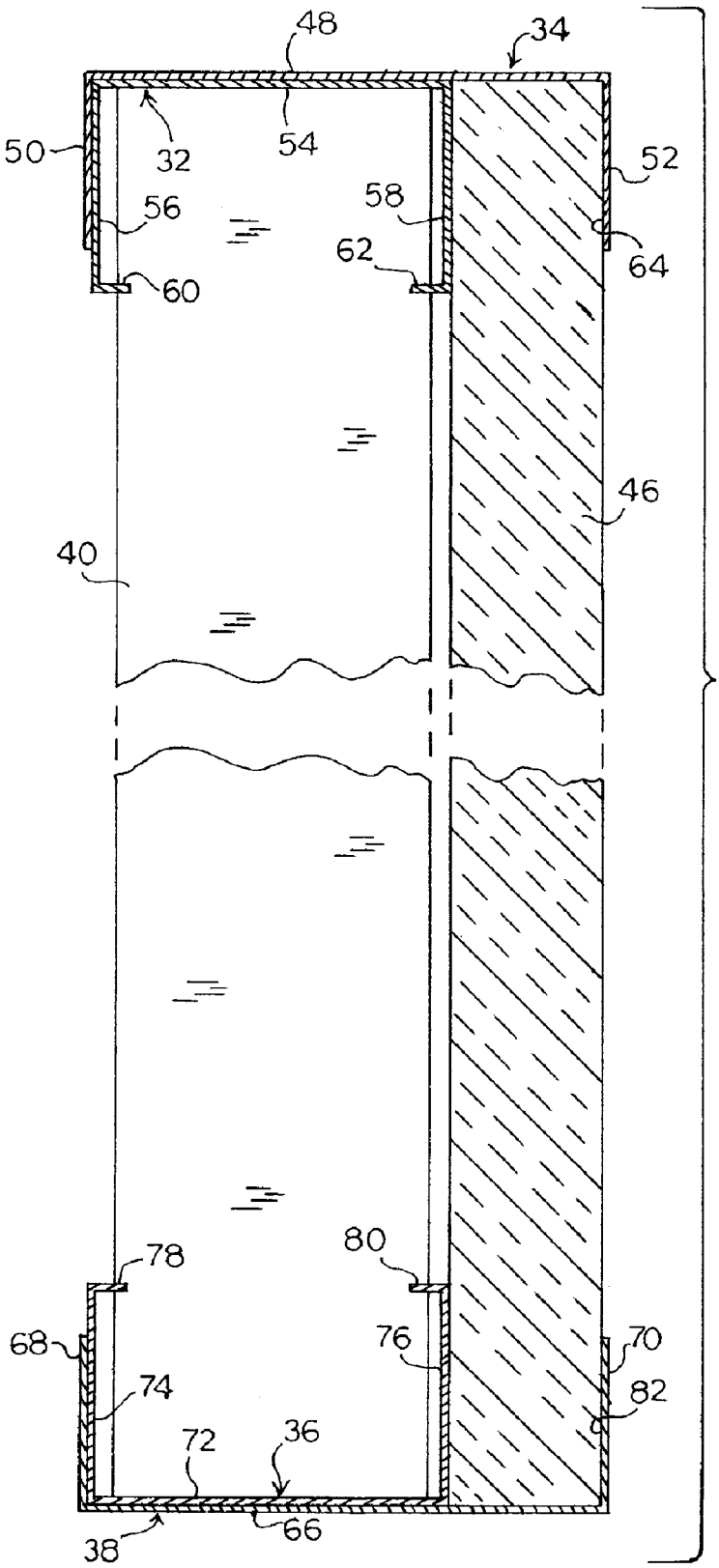
FIG. 2 is a section view of the thermal wall system of FIG. 1 taken along line 2-2 of FIG. 1.

A section view showing the top and bottom configurations is shown in FIG. 2. The top track 34 may be a "U" shape, having a horizontal web 48 with flanges 50, 52 extending downward from each edge. One flange, which generally may be expected to be on the interior side of the wall, may be referred to as an interior flange 50. The other flange may be referred to as an exterior flange 52. The top track 34 goes over and around the top plate 32, which also has a web 54, an interior downward flange 56, and an exterior downward flange 58, regardless of whether the top plate 32 is metal as shown or wood. The top plate may also have returns 60, 62, and is shown as a "C" shape. The webs 48, 54 and interior flanges 50, 56 are substantially nested with each other, and therefore may be considered to be in close and complementary registration. The exterior flanges 52, 58 are spaced from each other, and form a longitudinal opening 64. Rigid insulation 46 is disposed in the longitudinal opening 64. A stud 40 extends between the top and bottom plates 32, 36.

In a reverse arrangement to the top track 34 and plate 32, the bottom track 38 may be a "U" shape, having a horizontal web 66 with flanges 68, 70 extending upward from each edge. One flange may again be referred to as the interior flange 68. The other flange may be referred to as the exterior flange 70. The bottom track 38 goes beneath and around the bottom plate 36, which also has a web 72, an interior upward flange 74, and an exterior upward flange 76, regardless of whether the bottom plate 36 is metal as shown or wood. The bottom plate 36 may also have returns 78, 80, and is shown as a "C" shape. Again, the webs 66, 72 and interior flanges 68, 74 are substantially nested, and therefore may be considered to be in close and complementary registration. The exterior flanges 70, 76 are spaced from each other, and form a longitudinal opening 82 that is aligned with, and opposes, the longitudinal opening 64 at the top track 34 and plate 32. Rigid insulation 46 is disposed in the bottom longitudinal opening 82 as well as the top longitudinal opening 64.

Thermal framing components and a variety of their connections to framing members are shown in FIGS. 3-9. These components are also described in co-pending U.S. patent application Ser. No. 10/711,118, entitled "Thermal Framing Component" and filed on Aug. 25, 2004, the entire contents of which are hereby incorporated by reference.

Figure 3:
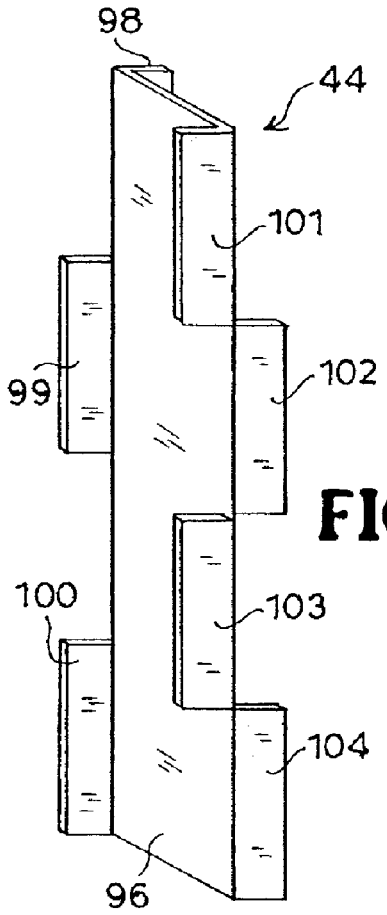
FIG. 3 is a perspective view of a portion of an embodiment of a thermal framing component for use in the thermal wall system of FIG. 1.

A portion of a thermal framing component 44 is shown in FIG. 3. The thermal framing component 44 has a web or spine 96. Along each edge of the web 96 are inner tabs 98-100 and outer tabs 101-104 that alternate in position. The lengths of the tabs may vary from that shown. One tab, across the web 96 from tab 103 and between tabs 99 and 100, is hidden from view behind the web 96, but should be understood to be similar to the tabs that may be seen, and in position like that of tab 98, which also resembles the other tabs. The tabs 98-104 form a slot on each side of the web 96. The edges of rigid insulation 46 may be placed and secured in the slot, and the edge of the insulation may be in close and complementary registration with the web 96. When the term "close and complementary registration" is used herein with respect to the web 96 and insulation 46, it should be understood to mean that the edge of the insulation is proximate to or abutting the web, and that the insulation edge is reciprocally received in the slot formed by the tabs.

Inner tabs 98-100 provide surfaces for mounting to the framing members (not shown), while outer tabs 101-104 provide mounting surfaces for exterior sheathing or finish material. Laterally aligned tabs, for example, tabs 98 and 101, 99 and 102, and 100 and 104, could be bent in the same direction and still be according to the present invention, but are shown to be bent in opposite directions. Bending such tabs in opposite directions provides clear, open access to the surface of the tab that is to be attached to a framing member. Tabs that are directly across the web from each other, or laterally aligned and at the same location along the longitudinal axis, may be considered to be in longitudinal registration.

Figure 4:
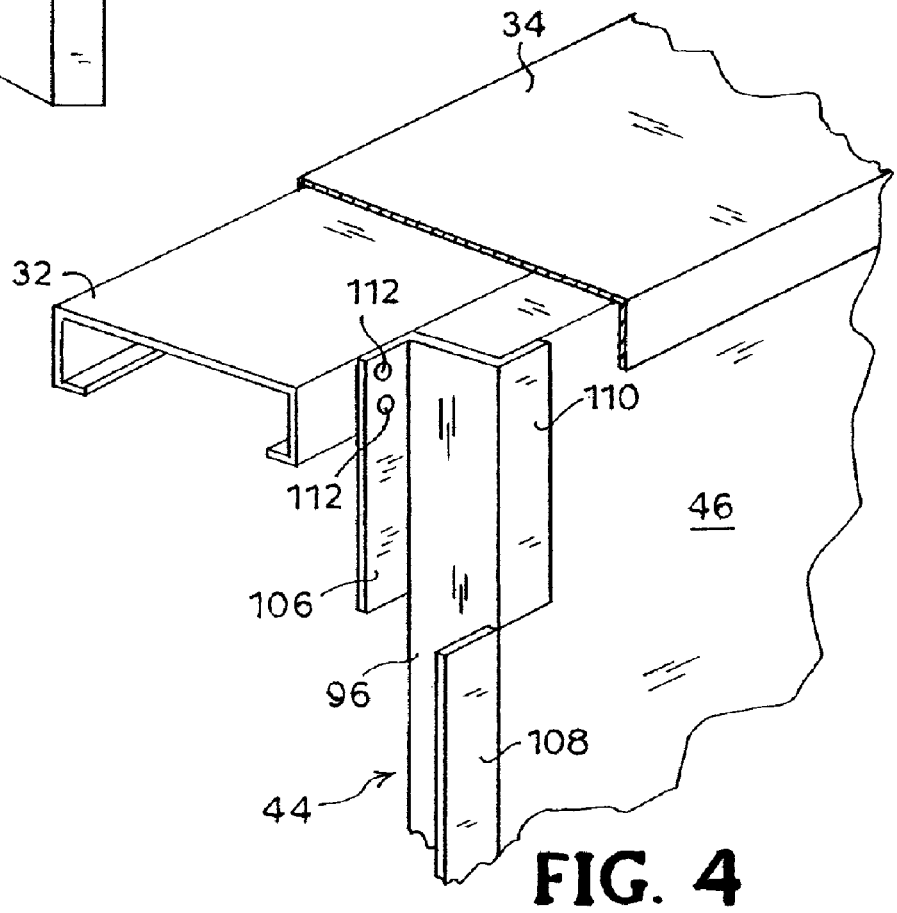
FIGS. 4-6 are perspective views of connections of the thermal framing component of FIG. 3 to light gauge steel framing members.
Figure 5:
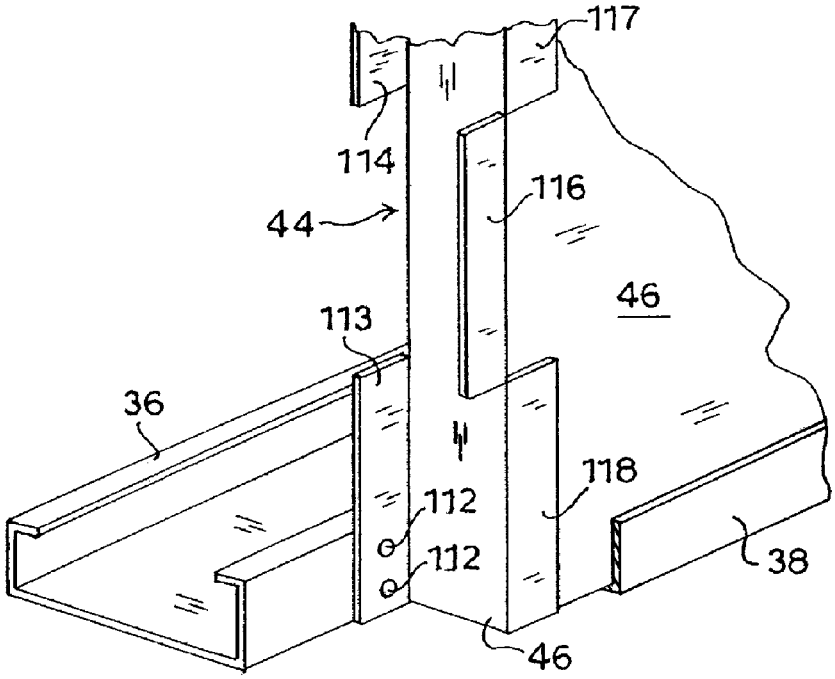
Figure 6:
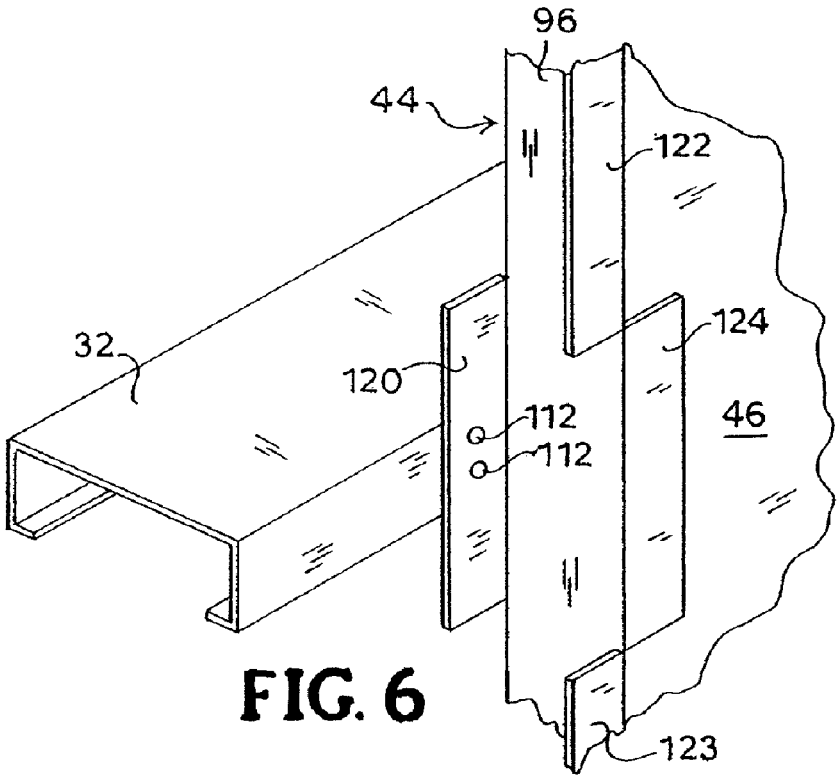

FIGS. 4-9 show how this clear access is provided, allowing a hammer, screwdriver, or other tool to be used to fasten a thermal framing component 44 to framing members. In FIGS. 4-6 a connection of a thermal framing component 44 to light gauge steel framing is shown. FIG. 4 shows a connection to the top plate 32. The top track 34 is disposed around the top plate 32 and rigid insulation 46, and is partially cut away to expose the connection of the thermal framing component 44 to the top plate 32. The thermal component 44 extends to present an inner tab 106 to the top plate 32. Inner tab 106 and outer tab 108 define a slot into which insulation 46 (not shown) may be placed. Outer tab 110 and inner tabs (not visible in FIG. 4) define another slot into which insulation 44 is placed. Outer tabs 108, 110 may present mounting locations for finish material. Two fasteners 112 are shown, which may be screws or the like. Depending on the material of the framing member to which the thermal framing component is to be mounted, nails, screws or other fasteners as known to one of ordinary skill in the art may be used.

FIGS. 5 and 6 show similar connections to the bottom plate 36 and to mid-span blocking 42, respectively. In FIG. 5 an inner tab 113 is attached to the bottom plate 36 with fasteners 112. Insulation 46 may be disposed in a slot formed by the inner tabs 113-114 and outer tab 116. Outer tabs 117-118 form one side of the slot in which insulation 46 is disposed. The bottom track 38 is disposed around the bottom plate 36 and rigid insulation 46, and is partially cut away to expose the connection of the thermal framing component 44 to the bottom plate 36. In FIG. 6, an inner tab 120 is attached to the mid-span blocking 42 with fasteners 112, and the inner and outer tabs 120, 122-123 form an insulation slot. An outer tab 124 forms one side of the opposing slot.

Figure 7:
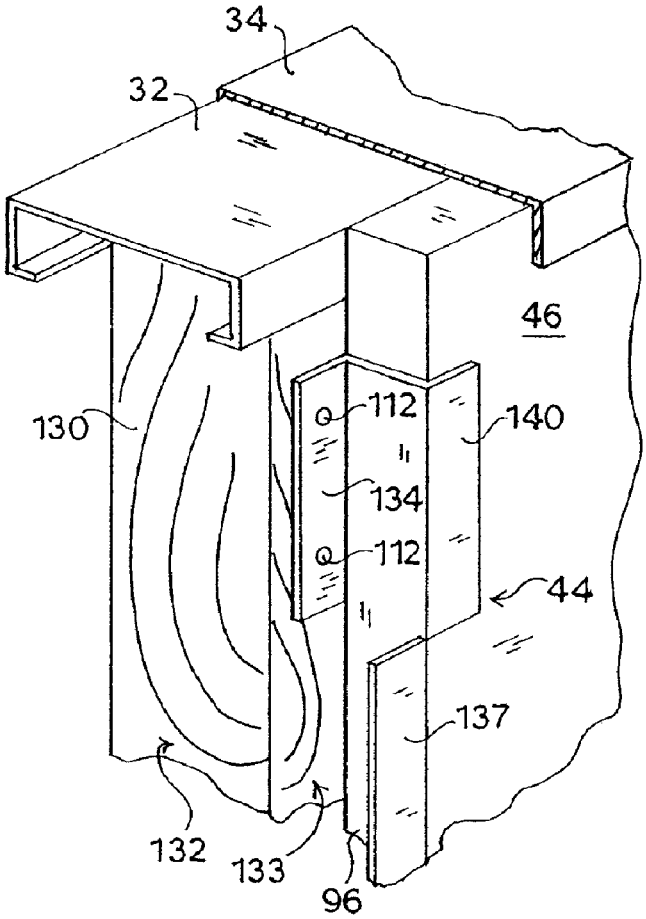
FIGS. 7 and 8 are perspective views of alternative connections of the thermal framing component of FIG. 3 to wood framing members.
Figure 8:
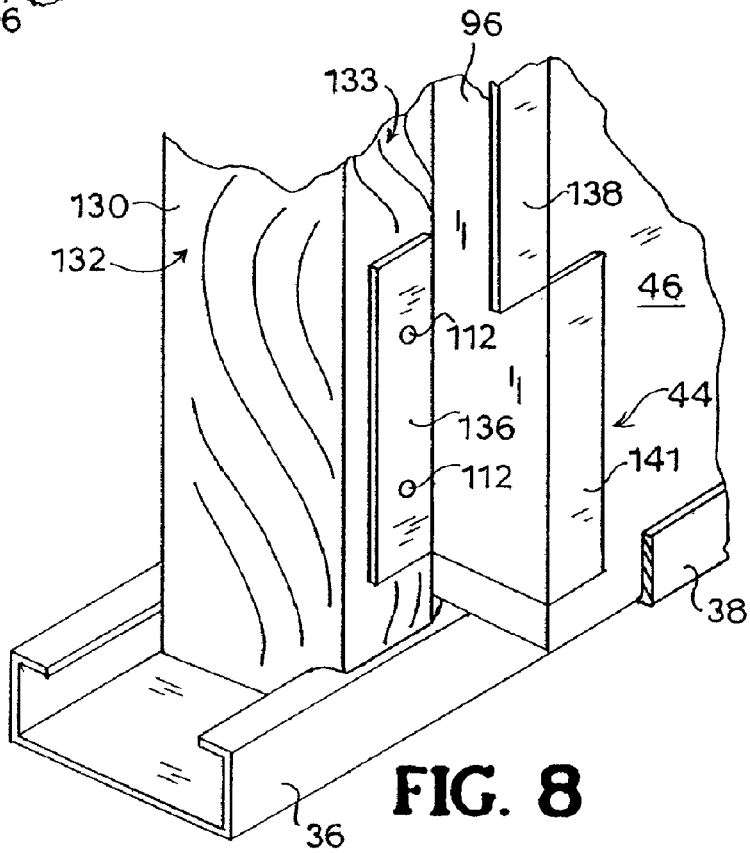

FIGS. 7 and 8 show a connection of a thermal framing component 44 to a wood stud 130 incorporated into light gauge steel framing. The top and bottom plates 32, 36 could also be made of wood. Alternatively, the studs could be steel. Studs, regardless of material, may be considered to have a web 132, which is in cross-section along the longer dimension, and a flange 133, which in cross-section is along the shorter dimension. The thermal component 44 is shown to stop short of contact with the metal plates 32, 36.

In FIGS. 7 and 8 the mounting of the component 44 is made near, but not to, the top plate 32 and bottom plate 36, and to the wall stud flange 133, with fasteners 112. The component 44 secures insulation 46 as discussed above. The connections could be made directly to the plates 32, 36 as in FIGS. 4 and 5. Inner tabs 134, 136 and outer tabs 137, 138, in FIGS. 7 and 8 respectively, form insulation slots. Inner tabs 134, 136 provide surfaces for mounting to the framing. Outer tabs 140, 141 form one side of an insulation slot. The outer tabs 137, 138, 140, 141 provide surfaces for mounting of finish material or exterior sheathing. The component 44 may also be connected at various locations along the stud 130.

Figure 9:
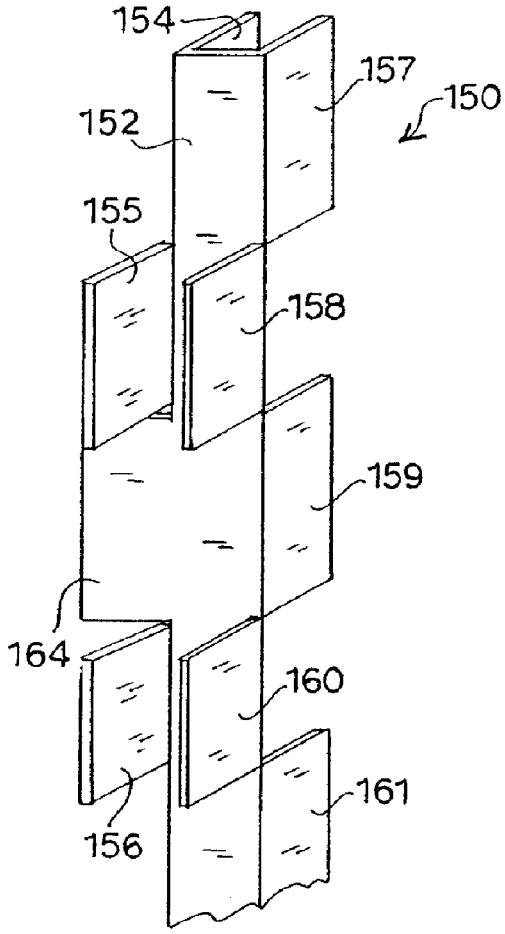
FIG. 9 is a perspective view of another embodiment of a thermal framing component for use in the thermal wall system of FIG. 1.

FIG. 9 shows another embodiment of a thermal framing component 150 in accordance with the present invention. This portion of a thermal component 150 includes a web 152, inner tabs 154-156, and outer tabs 157-161. Partially hidden tab 154 resembles the other tabs 155-161. Similar inner tabs that oppose outer tabs 159, 161 are not visible in FIG. 9. Another tab 164 extends from the web 152 in the same plane as the web 152. This tab 164 provides a mounting surface to mount the thermal component 150 to the stud web 132 rather than the stud flange 133 (FIGS. 7 and 8). Bent tabs 154-161 may be bent in either direction so long as a slot is formed to receive insulation 46.

Figure 10:
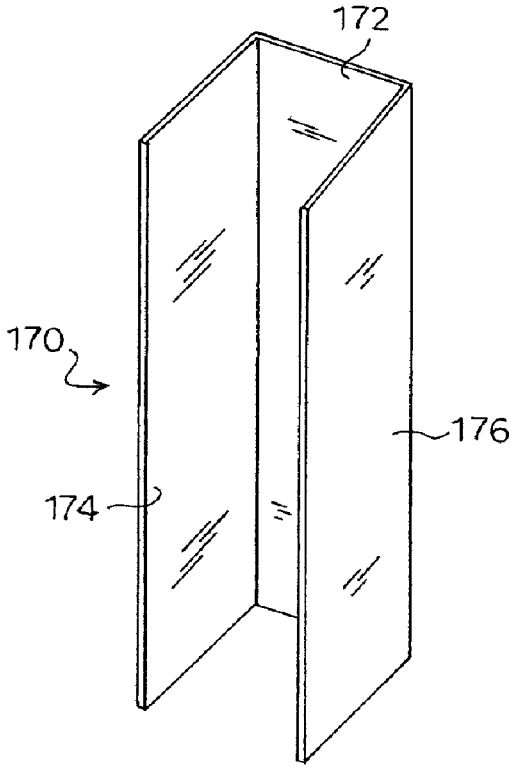
FIG. 10 is a perspective view of a portion of an embodiment of an end cap for use in the thermal wall system of FIG. 1.
Figure 11:
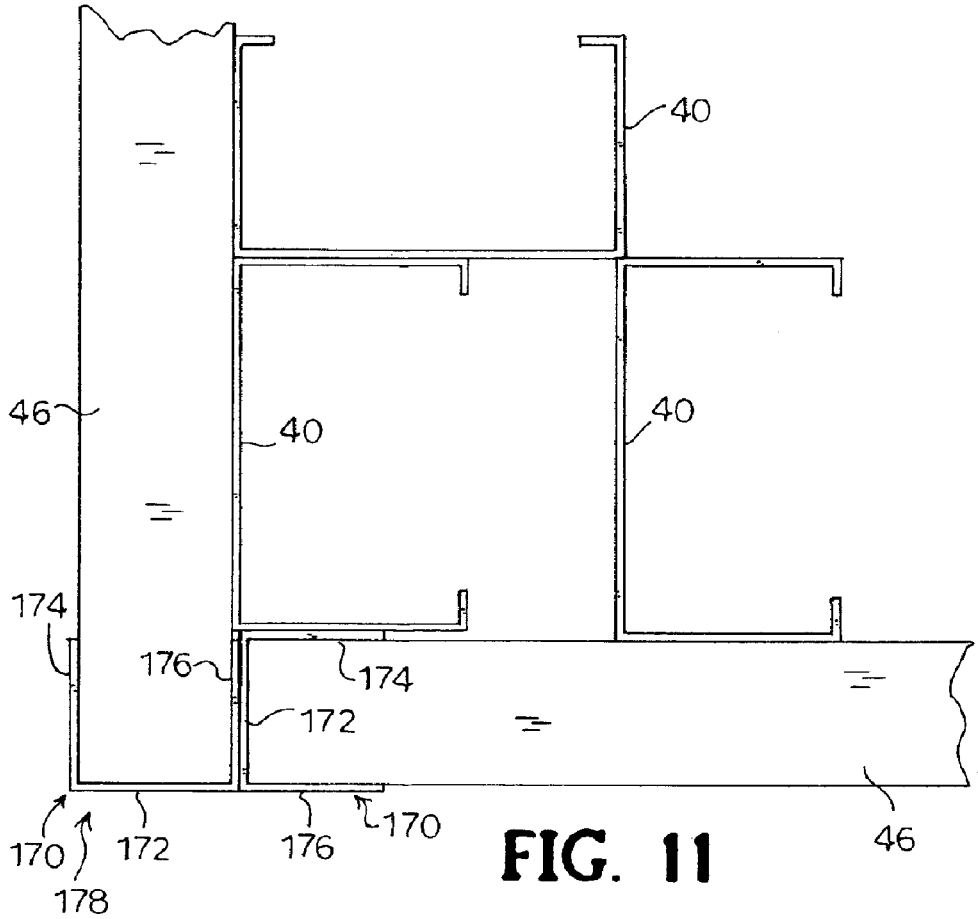
FIGS. 11 and 12 are plan views of arrangements of the end cap of FIG. 11.
Figure 12:
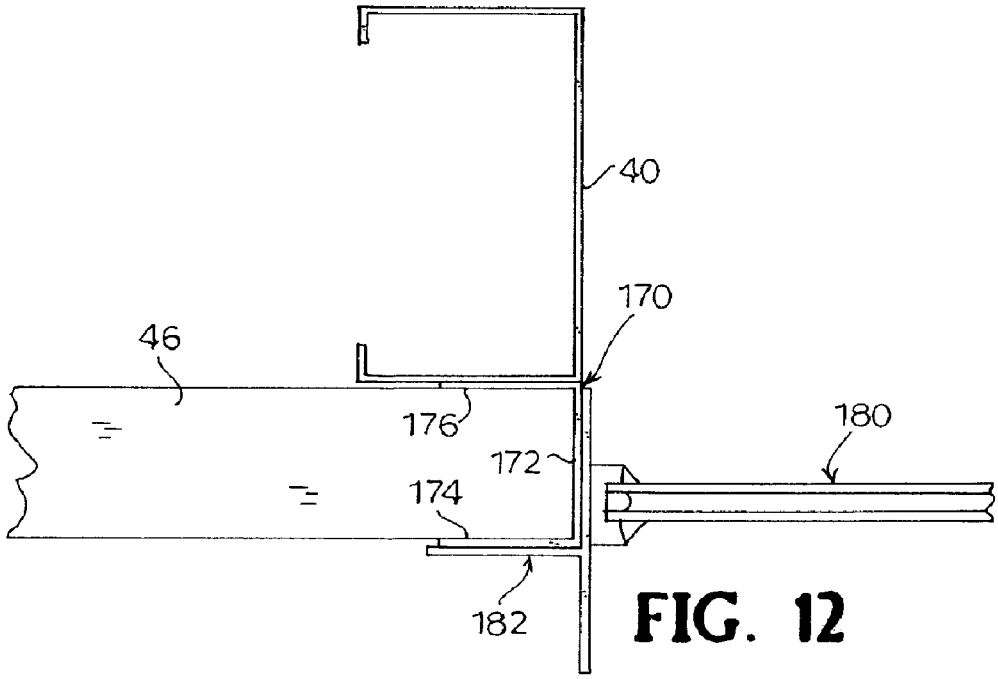

FIG. 10 shows a portion of a thermal end cap 170. A thermal end cap 170 may be a "U" section shape including a web 172 and two opposing flanges 174, 176. FIG. 11 shows an example use of end caps 170 for the treatment of insulation 46 at a wall corner 178. Two thermal end caps 170 receive the insulation 46 at the corner 178. Each end cap 170 fits over the edge of the insulation 46, with the vertical edge proximate to and possibly in contact with the web 172 and the sides of the insulation extending between the flanges 174, 176, generally extending from the top plate 32 to the bottom plate 36. The thermal end caps 170 can be fastened in a variety of ways, including but not limited to the use of screws or nails passing through an end cap flange 174, 176, then insulation 46, then the other end cap flange 176, 174, and then through a plate, stud 40, or adjacent end cap 170 as desired. Another example of an end cap 170 application is shown in FIG. 12. An end cap 170 is used to terminate the insulation at a junction with a window 180. A nailing flange 182 is provided with the window 180 and may be used to fasten the end cap 170 in position. The end cap may also be fastened to the stud 40 or a plate as previously discussed.

In one method of assembly, a thermal wall system may be constructed as a wall panel, which is then installed to frame the structure. First the top plate, bottom plate, and studs may be assembled. Then a thermal framing component, if any, may be added. One vertical edge of rigid insulation may be inserted into the slot formed by the tabs of the thermal component. Another thermal component may be positioned onto the free vertical edge of the insulation, and may be then mounted to the top plate and bottom plate. This process may be repeated to install the thermal components and insulation along the wall system. Alternatively, more than one thermal component may be mounted prior to inserting insulation, and then the insulation may be inserted by sliding it into the slots of the thermal components from either the top or bottom. The top track may be placed over the top plate and the adjacent top horizontal edge of insulation. Likewise, the bottom track may be placed under the bottom plate and the adjacent bottom horizontal edge of insulation. The tracks may be fastened in place. Mid-span blocking may also be provided, and thermal framing components may be mounted to the mid-span blocking if desired. Thermal end caps may be placed over the terminal vertical edge of insulation, or alternatively may be mounted first and then the insulation may be inserted by sliding into the end cap slot. The framing method may be performed, for example, as a prefabricated assembly offsite, or onsite. The assembly may also be performed in place, with the assembly being performed from the bottom upward.

Specific embodiments of an invention are described herein. One of ordinary skill in the structural engineering arts will recognize that the invention has other applications in other environments. For example, sheet materials other than rigid insulation may be mounted to the frame components. Different materials other light gauge steel, and wood may be used and remain within the scope of the present invention, such as other metals, composites, or plastics. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. A thermal wall system comprising:

a top track including a web in an approximately horizontal plane, a first flange and a second flange, the flanges of the top track extending only downward from the web of the top track at approximately right angles to the web of the top track;

a top plate including a web in an approximately horizontal plane, and only two flanges, the flanges including a first flange and a second flange, the flanges of the top plate extending only downward from the web of the top plate at approximately right angles to the web of the top plate, wherein the top plate is disposed in the top track such that the respective webs and first flanges of the top track and top plate are in direct contact and a longitudinal opening is formed between the second flanges of the top track and top plate;

a bottom track including a web in an approximately horizontal plane, a first flange, and a second flange, the flanges of the bottom track extending only upward from the web of the bottom plate at approximately right angles to the web of the bottom track;

a bottom plate including a web in an approximately horizontal plane, and only two flanges, the flanges including a first flange and a second flange, the flanges of the bottom plate extending only upward from the web of the bottom plate at approximately right angles to the web of the bottom plate, wherein the bottom plate is disposed in the bottom track such that the respective webs and first flanges of the bottom track and bottom plate are in direct contact and a longitudinal opening is formed between the second flanges of the bottom track and bottom plate; and vertical studs mounted to and extending between the top plate and bottom plate, wherein the top track and bottom track oppose each other, the top plate and bottom plate oppose each other, and the longitudinal openings oppose each other.

2. The thermal wall system of claim 1, further comprising rigid insulation generally distributed about a plane and disposed between the top and bottom tracks, including two approximately horizontal edges respectively disposed in the longitudinal openings and two approximately vertical edges.

3. The thermal wall system of claim 2, further comprising a vertical thermal framing component extending between the top and bottom plates, the thermal framing component including an elongated planar web perpendicular to the rigid insulation plane and projections from each edge at right angles to the web in both directions, such that a slot is formed with the web on each side of the web between the projections and an approximately vertical edge of the rigid insulation is disposed in the slot.

4. The thermal wall system of claim 3, further comprising a plurality of thermal framing components, wherein at least one thermal framing component is interposed between adjacent studs.

5. The thermal wall system of claim 3, further comprising a plurality of thermal framing components mounted to the second flange of the top and bottom plates.

6. The thermal wall system of claim 3, further comprising a plurality of thermal framing components mounted to studs that are steel or wood.

7. The thermal wall system of claim 3, further comprising approximately horizontal blocking between the vertical studs and mounted to the studs approximately half way between the top plate and bottom plate, wherein the thermal framing component is mounted to the blocking.

8. The thermal wall system of claim 3, wherein the elongated planar web has a longitudinal axis and comprises a first edge parallel to the longitudinal axis, a second edge parallel to the longitudinal axis, a first side, and a second side, and wherein the projections comprise at least:

a first planar tab extending from the first edge at approximately a 90 degree angle from the first side;

a second planar tab extending from the first edge at approximately a 90 degree angle from the second side in a direction opposite that of the first planar tab; and a third planar tab extending from the second edge at approximately a 90 degree angle from the second side in a direction opposite that of the first planar tab, wherein the third planar tab is in longitudinal registration with the first planar tab and wherein the second planar tab is longitudinally adjacent to the first planar tab.

9. The thermal wall system of claim 2, further comprising a thermal end cap including an approximately vertical web with flanges projecting from each edge at approximately right angles to one side of the web, wherein one approximately vertical edge of rigid insulation is disposed between the flanges.

10. The thermal wall system of claim 1, wherein the surfaces of the interior flange of the top track and the interior flange of the top plate are in direct contact, and the surfaces of the web of the top track and the web of the top plate are in direct contact, and wherein the surfaces of the interior flange of the top track and the interior flange of the top plate are in direct contact, and the surfaces of the web of the top track and the web of the top plate are in direct contact.

11. The thermal wall system of claim 10, wherein the top plate is substantially nested in the top track, and the bottom plate is substantially nested in the bottom track.

12. A thermal wall system comprising:

a top track including a web in an approximately horizontal plane, a first flange and a second flange, the flanges of the top track extending only downward from the web of the top track at approximately right angles to the web of the top track;

a top plate including a web in an approximately horizontal plane, and only two flanges, the flanges including a first flange and a second flange, the flanges of the top plate extending only downward from the web of the top plate at approximately right angles to the web of the top plate, wherein the top plate is disposed in the top track such that the respective webs and first flanges of the top track and the top plate are in direct contact and a longitudinal opening is formed between the second flanges of the top track and the top plate;

a bottom track including a web in an approximately horizontal plane, a first flange, and a second flange, the flanges of the bottom track extending only upward from the web of the bottom track at approximately right angles to the web of the bottom track;

a bottom plate including a web in an approximately horizontal plane, and only two flanges, the flanges including a first flange and a second flange, the flanges of the bottom plate extending only upward from the web of the bottom plate at approximately right angles to the web of the bottom plate, wherein the bottom plate is disposed in the bottom track such that the respective webs and first flanges of the bottom track and the bottom plate are in direct contact and a longitudinal opening is formed between the second flanges;

vertical studs mounted to and extending between the top plate and bottom plate;

vertical thermal framing components interposed between the studs and extending between the top and bottom plates, each including:

an elongated planar web including a longitudinal axis, a first edge parallel to the longitudinal axis, a second edge parallel to the longitudinal axis, a first side, and a second side;

a first planar tab extending from the first edge at approximately a 90 degree angle from the first side;

a second planar tab extending from the first edge at approximately a 90 degree angle from the second side in a direction opposite that of the first planar tab;

a third planar tab extending from the second edge at approximately a 90 degree angle from the second side in a direction opposite that of the first planar tab, wherein the second and third planar tabs form a first slot with the web; and a fourth planar tab extending from the second edge at approximately a 90 degree angle from the first side, wherein the first and fourth planar tabs form a second slot with the web, wherein the first and third planar tabs are in longitudinal registration, and wherein the second and fourth planar tabs are in longitudinal registration and are longitudinally adjacent to the first and third planar tabs; and first and second rigid insulation sheets disposed between the top and bottom tracks, each sheet including two approximately horizontal edges respectively disposed in the longitudinal openings and two approximately vertical edges, wherein an approximately vertical edge of the first rigid insulation sheet is disposed in the first slot and an approximately vertical edge of the second rigid insulation sheet is disposed in the second slot, wherein the top track and bottom track oppose each other, the top plate and bottom plate oppose each other, and the longitudinal openings oppose each other.

13. The thermal wall system of claim 12, further comprising a thermal end cap including an approximately vertical web with flanges projecting from each edge at approximately right angles to one side of the web, wherein one approximately vertical edge of rigid insulation is disposed between the flanges.

14. A method of assembling a thermal wall system, comprising:

providing a top plate including a web in an approximately horizontal plane, and only two flanges, the flanges including a first flange and a second flange, the flanges extending only downward from the web of the top plate at a right angle to the web of the top plate;

providing a bottom plate including a web in an approximately horizontal plane, and only two flanges, the flanges including a first flange and a second flange, the flanges extending only upward from the web of the bottom plate at a right angle to the web of the bottom plate;

providing approximately vertical studs;

mounting one end of at least two studs to the top plate and the other end to the bottom plate;

providing a top track having a web in an approximately horizontal plane, an interior flange, and an exterior flange, the flanges extending only downward from the web of the top track at a right angle to the web of the top track;

providing a bottom track having a web in an approximately horizontal plane, an interior flange, and an exterior flange, the flanges extending only upward from the web of the bottom track at a right angle to the web of the bottom track;

mounting the top track or bottom track to the respective top plate or bottom plate, wherein the respective plate is disposed in the selected track such that the plate and track respective webs and first flanges are in direct contact and a first longitudinal opening is formed between the second flanges;

providing at least one rigid insulation sheet to fit between the top and bottom track and corresponding longitudinal openings;

inserting one horizontal edge of the rigid insulation sheet into the first longitudinal opening;

mounting the remaining track to the respective remaining plate, wherein the remaining plate is disposed in the remaining track such that the remaining plate and remaining track respective webs and first flanges are in direct contact and a second longitudinal opening is formed between the second flanges, wherein the other horizontal edge of the rigid insulation sheet is inserted in the second longitudinal opening.

15. The method of assembling a thermal wall system of claim 14, further comprising:

providing at least two vertical thermal framing components, each including a web and projections from each edge at right angles to the web in both directions, such that a slot is formed that is defined by the web and the projections on each side of the web of the thermal framing component;

mounting the thermal framing components to the top and bottom plates before mounting the top and bottom tracks to the respective plates; and inserting each approximately vertical edge of the rigid insulation sheet into one thermal framing component slot.

16. The method of assembling a thermal wall system of claim 15, wherein providing at least two thermal framing components comprises providing thermal framing components including:

an elongated planar web including a longitudinal axis, a first edge parallel to the longitudinal axis, a second edge parallel to the longitudinal axis, a first side, and a second side;

a first planar tab extending from the first edge at approximately a 90 degree angle from the first side;

a second planar tab extending from the first edge at approximately a 90 degree angle from the second side in a direction opposite that of the first tab; and a third planar tab extending from the second edge at approximately a 90 degree angle from the second side in a direction opposite that of the first tab, wherein the third tab is in longitudinal registration with the first tab and wherein the second tab is longitudinally adjacent to the first tab.

17. The method of assembling a thermal wall system of claim 15, further comprising:

providing horizontal blocking;

mounting the horizontal blocking between the vertical studs approximately half way between the top plate and bottom plate; and mounting the thermal framing components to the blocking.

18. The method of assembling a thermal wall system of claim 14, further comprising:

providing a thermal end cap comprising a vertical web with opposing flanges projecting from each edge at right angles to one side of the web; and mounting the thermal end cap on a vertical edge of a rigid insulation sheet, wherein the edge of the insulation is between the flanges.

* * * * *